United States Patent [19]

Bull

[11] Patent Number: 4,496,099

[45] Date of Patent: Jan. 29, 1985

[54] LOW PRESSURE HEATING SYSTEM

[76] Inventor: Garland Bull, Rte. 1, Box 235, Dardanelle, Ark. 72834

[21] Appl. No.: 586,138

[22] Filed: Mar. 5, 1984

[51] Int. Cl.[3] ..... F24H 3/06

[52] U.S. Cl. ..... 237/7; 126/101; 237/16; 237/78 R

[58] Field of Search ..... 126/132, 374, 101, 99 R, 126/113, 116 A; 237/7, 16, 17, 18, 78 R, 66; 165/106, 40; 236/15 R, 21 B, 10; 110/234

[56] References Cited

U.S. PATENT DOCUMENTS

| | | | |
|---|---|---|---|
| 1,778,146 | 10/1930 | Davis | 237/7 |
| 2,477,734 | 8/1949 | Gehrke | 237/7 |
| 2,509,624 | 5/1950 | Baumann | 237/7 |
| 3,277,275 | 10/1966 | Brusner | 237/7 X |
| 3,681,567 | 8/1972 | Boecher | 237/16 X |
| 4,105,894 | 8/1978 | Parks | 237/16 X |
| 4,340,026 | 7/1982 | Smith | 126/5 |
| 4,344,411 | 8/1982 | Dearborn | 126/5 X |
| 4,424,934 | 1/1984 | Wilhoite | 237/7 |

FOREIGN PATENT DOCUMENTS

| | | | |
|---|---|---|---|
| 496653 | 11/1919 | France | 237/16 |

*Primary Examiner*—Larry Jones

*Attorney, Agent, or Firm*—Stephen D. Carver

[57] ABSTRACT

A low pressure system for extracting heat from the fire combustion zone within a fireplace, wood or coal burning stove, or the like, and for automatically distributing it within a region adjacent to the fire. Preferably the apparatus includes a first heat exchanger adapted to be disposed within the fire combustion zone, and a remote reservoir containing a volume of a preselected working heat exchange fluid, preferably water. The reservoir is vented to the atmosphere and it is in fluid flow communication with an electrical circulating pump which forwards the heat exchange medium under relatively low pressure to the first heat exchanger within the fire combustion zone. A second heat exchanger preferably remotely disposed from the fire combustion zone and the reservoir is in fluid flow communication with the first heat exchanger, and thus warms up in response to circulation of fluid. An immersion control switch operatively associated with the reservoir initiates operation of the pump to establish fluid recirculation between the first and second heat exchangers in response to a thermocouple disposed within the reservoir. A fan assembly associated with the second heat exchanger includes a temperature responsive control which limits operation to a proper temperature. A solenoid valve preferably coupled in fluid flow communication between the pump outlet and the reservoir is controlled by the immersion control switch for bypassing the pump and draining the heat exchangers when either the thermocouple senses a preselected maximum temperature or electrical power is interrupted.

15 Claims, 4 Drawing Figures

LOW PRESSURE HEATING SYSTEM

BACKGROUND OF THE INVENTION

The present invention relates generally to heat extraction devices adapted to be used with wood burning or coal burning stoves and fireplaces. More particularly, the present invention relates to a heat exchange system, including a stove and/or a fireplace insert equipped with the system, for extracting heat from burning fossil fuels for warming an adjacent region.

In the prior art a wide variety of fossil fuel stoves, fireplace inserts, and related devices have been proposed. It is known to recirculate a heat exchange working medium between the fire combustion zone within a fireplace, fireplace insert or wood burning stove etc., and to thereafter extract heat and distribute it within an inhabitable region or volume. Most typical prior art systems employ a tubular heat exchanger device disposed within the fire combustion zone of a stove or fireplace etc., and circulate water between it and a remote heat exchanger for thereafter extracting heat from the second heat exchanger by passing air therethrough. The problem with many prior art devices relates to the high pressure operating points chosen. Moreover, a variety of disadvantageous operational problems occur with typical known prior art systems. For example, closed systems present an obvious danger when safe operating temperatures are exceeded. Closed systems are also particularly vulnerable to the buildup of scale and unwanted residue upon the interior of critical tubular passageways, and they necessitate a great deal of extra maintenance. Moreover, typical closed systems require the use of heavier gauge tubing and fittings in compliance with heating and air conditioning codes and regulations. The latter factor results in increased manufacturing expense as well as increased product weight. For consumers desiring to install a heat exchange system of the type discussed by themselves, reduced weight and operational simplicity are advantageous design goals. Most consumers, for example, simply lack the tools, conpetence and expertise to properly install known high pressure closed heat exchange systems of the type reflected by known prior art.

Another problem with prior art devices known to me includes the "automatic" features of such systems. For example, each system must include some form of water or liquid circulating pump to circulate the working heat exchange fluid between heat exchangers and the fuel combustion zone. I have found that the use of a separate reservoir system, preferably disposed apart from the heat exchanger and the fuel combustion zones, may be particularly advantageous in a low pressure system, while particularly vexatious when used in conjunction with a high pressure system. When electrical circuits fail or when electrical power is interrupted, electrical recirculating pumps will of course stop, and operation of the system must be reliably interrupted. However, as will be appreciated by those skilled in the art, a significant lag time exists between electrical power failure and the resultant drop in system temperature and pressure.

It is therefore advantageous to present a system which will automatically drain the otherwise dangerous remote air/heat exchangers and which will automatically fill the reservoir. Examples of prior art include U.S. Pat. Nos. 1,419,367; 4,206,804; 4,154,210; 4,142,506; 4,340,026; 4,252,104; and 4,344,411. Known relevant foreign prior art patents include French Pat. No. 2,485,697 and U.K. patent application No. 2,044,441.

SUMMARY OF THE INVENTION

The present invention comprises a system for extracting heat from the fire combustion zone within a fireplace, wood or coal burning stove, or the like, and for automatically distributing it within a region adjacent to the fire. Preferably the apparatus includes a first heat exchanger adapted to be disposed within the fire combustion zone and a remote reservoir containing a volume of a preselected working heat exchange fluid, preferably water. The reservoir is vented to the atmosphere and it is in fluid flow communication with an electrical circulating pump which forwards the heat exchange medium under relatively low pressure to the first heat exchanger within the fire combustion zone. A second heat exchanger preferably remotely disposed from the fire combustion zone and the reservoir is in fluid flow communication with the first heat exchanger, and thus warms up in response to circulation of fluid. An output of the second heat exchanger communicates with a reservoir to complete a recirculation pathway.

Preferably two electrical fans are employed in conjunction with a second heat exchanger to distribute air therethrough, thereby causing the warming of the air and the circulation of heat within the adjacent area. An immersion control switch opertatively associated with the reservoir initiates operation of the pump to establish fluid recirculation between the first and second heat exchangers in response to a thermocouple disposed within the reservoir. The fan assembly associated with the second heat exchanger includes a temperature heat responsive control associated with the second heat exchanger to automatically operate when the temperature of the second heat exchanger reaches a preselected variable temperature.

A solenoid valve is preferably coupled in fluid flow communication between the pump outlet and the reservoir. This solenoid is controlled by the immersion control switch for bypassing and draining the heat exchangers when either the thermocouple senses a preselected maximum temperature or electrical power for the immersion control switch is interrupted. A suction trap disposed between the outlet of the second heat exchanger and the inlet of the reservoir enables the second heat exchanger to drain properly upon cessation of electrical current, but maintains the second heat exchanger at an ambient liquid level. Low level warning means associated with a reservoir generate a warning when the temperature of the heat exchange fluid therewith is impermissably low. The reservoir further includes a port which enables initial inputting of liquid to the apparatus and facilitates venting of the reservoir. The vent port thus prevents reservoir head pressure from exceeding atmospheric pressure and facilitates the escape of steam whereby to humidify the area in which the reservoir is disposed concurrently with heat distribution.

The system may be employed in conjunction with a wood or coal burning stove incorporating the features thereof. Moreover, the system may be sold as a kit adapted to be retro-fitted to existing fireplaces, fireplace inserts, or coal or wood burning stoves etc. Moreover, the system may be incorporated within a fireplace insert for use along the lines discussed above.

Thus an object of the present invention is to provide a low pressure heat exchange system for automatically and continuously circulating and warming air.

Moreover it is a specific object of the present invention to extract and distribute heat from a wood burning or coal burning stove, a fireplace, or fireplace insert or the like.

Yet another object of the present invention is to provide a system of the character described which may be sold as a kit for retro-fitting in existing fireplaces, fireplace inserts, coal or wood burning stoves or the like.

Another object of the present invention is to provide a fireplace insert equipped with the heat exchange system described.

A still further object of the present invention is to provide a safe and reliable heat exchange system. It is an important feature of the present invention that the reservoir is vented to atmosphere, and the system is characterized by a relatively low internal operating temperature.

A further object of the present invention is to provide a system of the character described which may be manufactured conveniently with low pressure components.

Another object of the present invention is to provide a heat extraction system for warming remote areas by distributing heat generated by conventional fireplaces, wood burning stoves or the like.

Yet another object of the present invention is to provide a system of the character described which will automatically shut down in response to an excessive temperature.

A siilar object of the present invention is to provide a system which will automatically drain when electrical power is interrupted.

Yet another object of the present invention is to provide a heat exchange and distribution system which will humidify the area in which the system is disposed.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
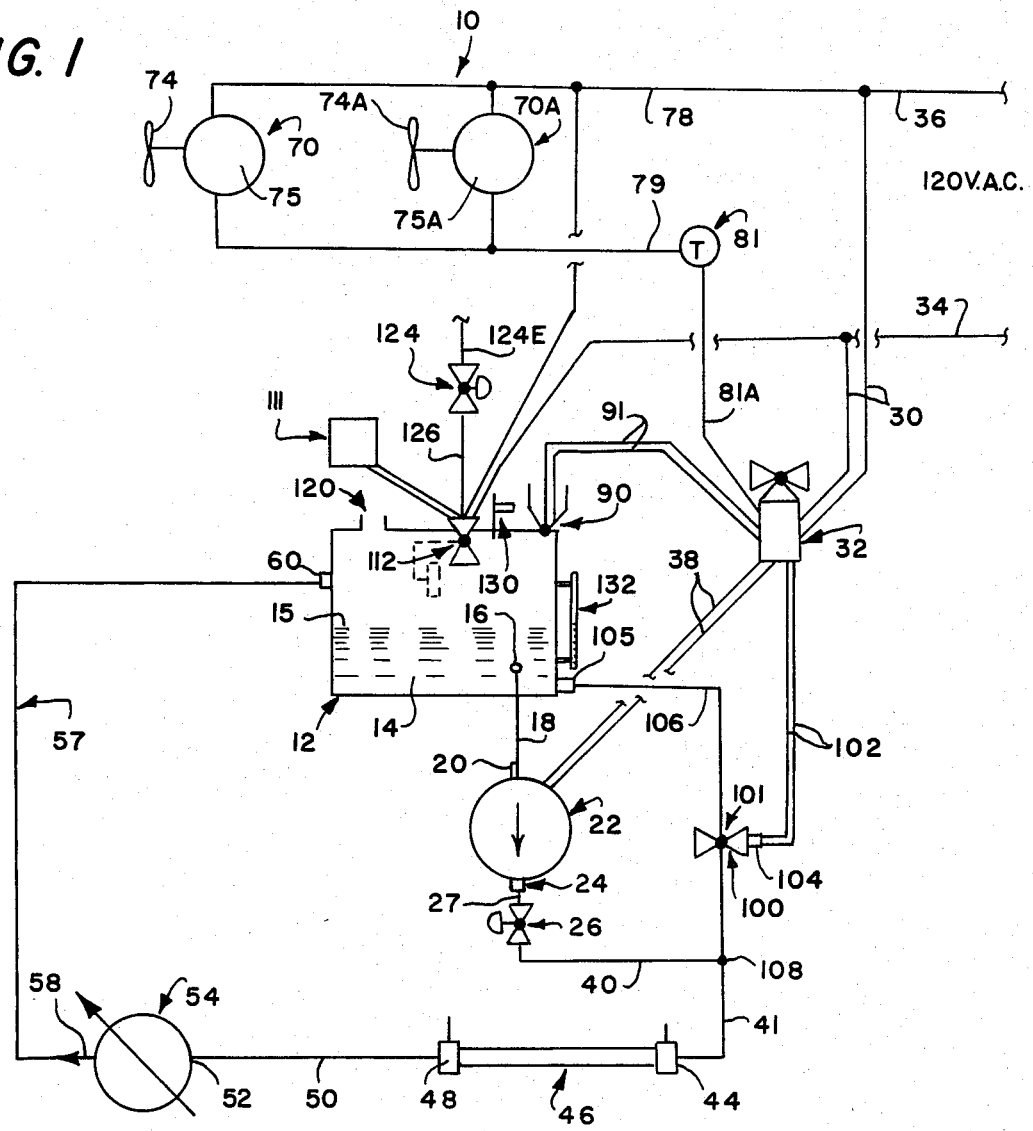
FIG. 1 is a combined diagrammatic and schematic view illustrating fluid flow and component interconnection of the present invention.
Figure 2:
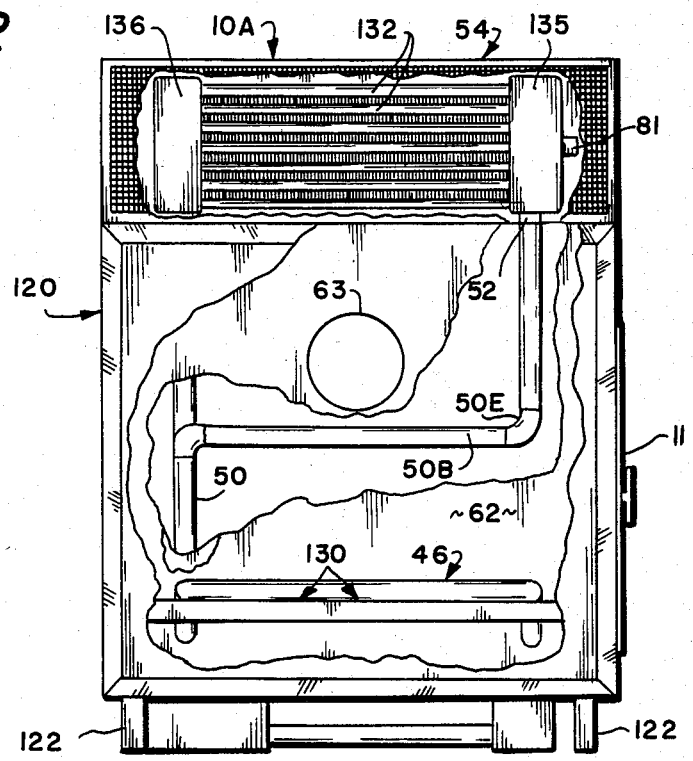
FIG. 2 is a fragmentary plan view illustrating a coal or wood burning stove constructed in accordance with the teachings of the present invention, which, when configured as hereinafter discussed, will also function as a fireplace insert.

FIG. 1 of the drawings illustrates the basic fluid flow and electrical control systems of the invention. It will be appreciated by those skilled in the art that the apparatus illustrated in FIG. 1 may be employed advantageously in conjunction with existing wood burning or coal burning stoves or fireplace inserts, fireplaces or the like. Alternatively it will be appreciated that the wood or coal burning stove shown in FIGS. 2 and 3 will incorporate the basic invention of FIG. 1. Moreover, the system illustrated in FIG. 1 may be retro-fitted to existing fireplace inserts, stoves, and fireplaces. Providing the apparatus of FIG. 2 is suitably configured, it may be employed as a fireplace insert.

Figure 3:
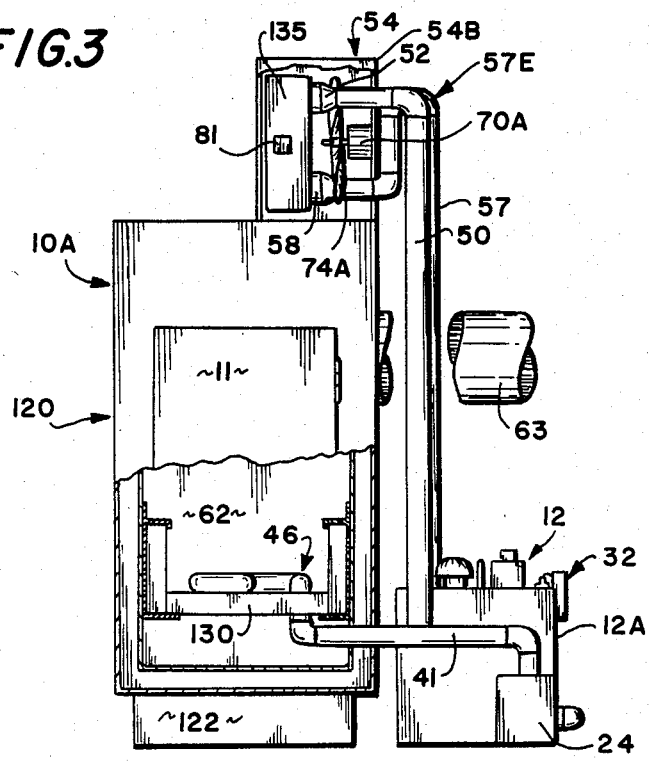
FIG. 3 is a fragmentary side view of the apparatus of FIG. 2.
Figure 4:
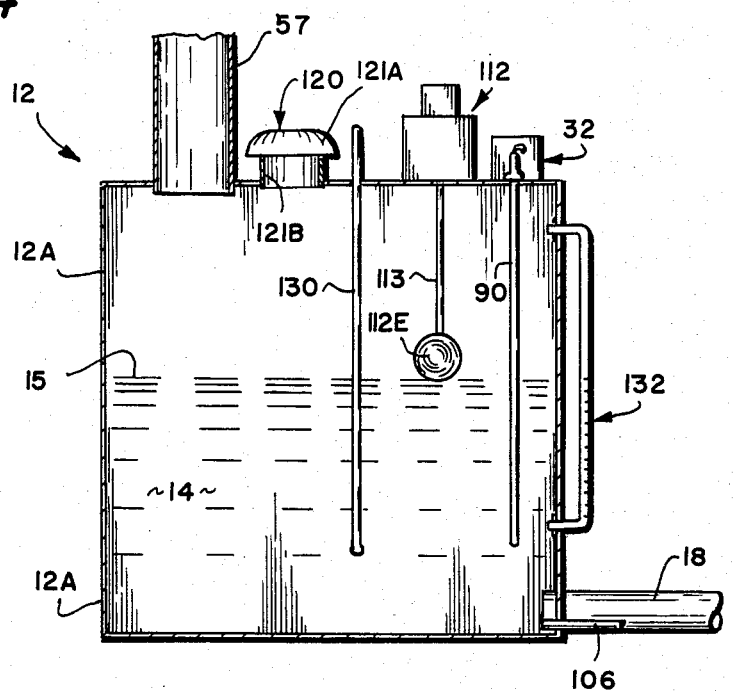
FIG. 4 is an enlarged, fragmentary sectional view of the preferred reservoir employed by the instant invention.

The system, which has been generally designated by the reference numeral 10, comprises a reservoir tank assembly 12 which contains a preselected volume of a working heat exchange fluid 14 such as water, ethylene glycol, or the like. Fluid head 15 is disposed interiorly of the generally cubicle, metallic tank 12A (FIGS. 3, 4). Fluid is extracted from reservoir outlet 16 through a line 18 through pump input 20 into a conventional electrical circulating pump 22. Pump 22 ideally may comprise a Teel brand water circulating pump, Model 1P965. Pump 22 includes a water outlet 24 coupled to a valve 26 via a line 27. A pair of electrical lines 30 coupled to an immersion control switch 32 are connected across power input lines 34, 36 to deliver nominally a 120 volt alternating current to the immersion control switch 32. The latter switch transmits power via lines 38 to control pump 22, which thus forces heat exchange fluid through lines 40 and 41 into the input 44 of a first heat exchanger generally designated by the reference numeral 46. The output 48 of heat exchanger 46 communicates via a line 50 with the input 52 of a second heat exchanger 54. Heat exchanger 46 is adapted to be located within the fuel combustion zone of a stove, fireplace or fireplace insert. Exchanger 54 may be located remotely, and, as will hereinafter be described, it is associated with fan apparatus for warming the region in which it is disposed.

A hot fluid return line generally designated by the reference numeral 57 is coupled between the outlet 58 of heat exchanger 54 and an inlet 60 of the reservoir 12. Thus the heat exchange fluid will continuously recirculate between the two heat exchangers and the reservoir depending upon control settings and commands. With reference to FIG. 2, the first heat exchanger 46 is illustrated disposed within the fire combustion zone 62 of the stove 10A, which is constructed in accordance with the teachings of the present invention.

A pair of fan assemblies generally designated by the reference numerals 70 and 70A include fan blades 74 and 74A which force air across heat exchanger 54. These fans are driven by electric motors 75, 75A respectively, which are powered by lines 78, 79. Fan control is effectuated by the immersion control switch 32, in conjunction with a thermostat 81, which is physically associated with the second heat exchanger 54. Thermocouple 81 normally joins electric lines 79 and 81A to facilitate fan control by immersion control switch 32, but it interrupts fan operation when the temperature within heat exchanger 54 is too low, and it initiates fan operation when the reservoir temperature is proper. In the preferred embodiment fan operation commences at approximately 150 degrees, but, if the fire goes down and temperatures drop, it shuts of the fans at approximately 120 degrees. The control switch 32 which controls the pump 22 and the fan motors 75, 75A preferably comprises a Dayton brand hot water control, model 2E376 or 2E376A.

The immersion control switch 32, which senses reservoir temperature by a thermocouple 90 associated with the reservoir tank 12A, is coupled to thermocouple 90 via electrical lines 91. Nominally the immersion control switch "upper limit" setting is set to interrupt pump operation at a temperature of 200 degrees. Switch 32 also electrically controls a reservoir bypass valve generally designated by the reference numeral 100.

Power is supplied across lines 102 to a conventional solenoid 104 associated with valve 101. Valve 101 is coupled to a reservoir outlet 105 via a conduit 106, and is also coupled to previously described conduits 40, 41 at a T-intersection 108. This pathway established by lines 100, 106 and the valve 101 effectively bypasses pump 22 and facilitates the draining of the heat exchangers 46, 54 when either a preselected maximum temperature is sensed by thermocouple 90 or when power is interrupted along power input lines 34, 36.

The reservoir 12 is also equipped with a low level switch alarm generally designated by the reference numeral 111 which is responsive to a conventional float switch 112 associated with the reservoir. The reservoir tank 12A includes a vent, generally designated by the reference numeral 120, which facilitates initial filling of the device and enables excess steam pressure to escape, thereby humidifying the area in which the reservoir is disposed. Preferably a globe valve 124 is coupled to a supply of fresh water via line 124E. This valve may be opened to initially fill the reservoir 12 via a line 126. Float switch 112 controls the fill input appearing on line 126. Reservoir temperature may be monitored by the consumer through a thermometer 130. A sight glass 132 monitors water level within the reservoir. Thus head level 15 may be visually perceived by the consumer by watching the sight glass 132.

With reference now to FIGS. 2 and 3, FIG. 10 broadly designates a wood burning or coal burning stove equipped with the present invention. The stove 10A preferably comprises an upright, generally cubical, rigid metallic enclosure, generally designated by the reference numeral 120, which includes lower rigid supporting feet 112 for disposing it upon a suitable supporting surface. Gases liberated from fuel combustion region 62 may be outputted through a conventional flue 63. A door 11 associated with the stove 10A may of course be opened or closed conventionally. The second heat exchanger, previously discussed, is preferably disposed on top of the stove 10A, but may be located remotely therefrom. Moreover, it will be appreciated that when the stove enclosure 120 is appropriately dimensioned, it will fit within the hearth of a conventional fireplace, so that unit 10A will function as a fireplace insert once the heat exchanger 54 is suitably remotely secured.

The first heat exchanger 46 is disposed within the heat generating or fuel combustion zone 62, and it includes coiled tubing generally designated by a reference numeral 130 upon which, or adjacent to which a combustible fuel such as coal or wood may be disposed. The output line 50 of the first heat exchanger extends vertically upwardly to a horizontal member 50B communicating through an elbow 50E to the input 52 of the second heat exchanger 54. A plurality of heat exchange coils 132 are arranged within enclosure 54B in generally horizontal rows which are suspended between support ends 135 and 136. The previously discussed fan assemblies 70, 70A are disposed upon opposite interior sides of the enclosure 54B. The output 58 of the second heat exchanger communicates through a suction trap designated by the reference numeral 57E with the output 57 returning fluid to reservoir 12.

With reference now to FIG. 4, the reservoir 12 includes a generally cubical, rigid, metallic enclosure 12A in which the heat exchange medium 14 is disposed. The float valve assembly 112 includes a float 112E communicating through a stanchion 113 for automatically adjusting the fluid level. Vent assembly 120 includes a pipe outlet 121B which mounts a removable cap 121A. The cap includes a perforated top such that steam may escape from the reservoir interior to humidify the area in which the apparatus is disposed.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A low-pressure heating device for warming the areas in which the device is disposed by extracting heat from a wood burning or coal burning stove, fireplace or the like, said wood or coal burning stove, fireplace or the like having an internal fuel combustion zone, the device comprising:

a first heat exchanger adapted to be disposed within said stove or the like within said fuel combustion zone therewithin, said first heat exchanger having a first fluid inlet and a first fluid outlet;

a reservoir adapted to be disposed remotely with respect to said combustion zone for containing a preselected volume of a working heat exchange fluid such as water or the like, said reservoir being vented to the atmosphere and having at least one reservoir inlet and a reservoir outlet;

a circulating pump for extracting said heat exchange fluid from said reservoir and for pumping it to said first heat exchanger, said pump having an inlet in fluid flow communication with said reservoir outlet and a pump outlet in fluid flow communication with said first fluid inlet associated with said first heat exchanger;

a second heat exchanger adapted to be disposed remotely from said reservoir and combustion zone but elevated above said reservoir, said second heat exchanger having a second fluid flow inlet and a second fluid flow outlet;

said second fluid flow inlet coupled in fluid flow communication with said first fluid flow outlet;

said second fluid flow outlet coupled in fluid flow communication with at least one of said reservoir inlet(s);

fan means for forcing air through said second heat exchanger to extract and distribute heat therefrom;

immersion control switch means operatively associated with said reservoir for initiating operation of said pump whereby to establish fluid recirculation between said reservoir and said first and second heat exchangers;

fan control means for energizing said fan means when the temperature of fluid within said second heat exchanger reaches a first preselected temperature; and, said immersion control means being responsive to thermocouple means disposed within said reservoir for turning off said pump when the temperature of fluid within said reservoir exceeds a preselected safe maximum temperature, whereupon hot fluid disposed within said second heat exchanger will drop downwardly into said reservoir.

2. The heating device as in claim 1 including solenoid valve means coupled in fluid flow communication between said pump outlet and said reservoir and electrically controlled by said immersion control switch for bypassing and draining said heat exchangers when either said thermocouple means senses said preselected maximum temperature or electrical power for said immersion control switch means is interrupted.

3. The heating device as defined in claim 2 including suction trap means disposed in fluid flow communication between said second heat exchanger outlet and said reservoir inlet.

4. The device of claim 3 including vent means for venting the fluid head within said reservoir to prevent reservoir head pressure from exceeding atmospheric pressure and for facilitating the escape of steam whereby to concurrently humidify said area in which said device is disposed.

5. The device as in claim 3 including low level warning means associated with said reservoir operable when said heat exchange fluid within said reservoir assumes an impermissibly low operating level to generate a warning and to admit heat exchange fluid into said reservoir to maintain a proper operating level.

6. A wood or coal burning stove for warming the areas in which said stove is disposed, said stove comprising:

a rigid, upright frame adapted to be disposed upon a suitable supporting surface;

an internal fuel combustion zone for burning coal or wood to generate heat;

a first heat exchanger adapted to be disposed within said stove fuel combustion zone, said first heat exchanger having a first fluid inlet and a first fluid outlet;

a reservoir adapted to be disposed remotely with respect to said combustion zone for containing a preselected volume of a working heat exchange fluid such as water or the like, said reservoir being vented to the atmosphere and having at least one reservoir inlet and a reservoir outlet;

a circulating pump for extracting said heat exchange fluid from said reservoir and for pumping it to said first heat exchanger, said pump having an inlet in fluid flow communication with said reservoir outlet and a pump outlet in fluid flow communication with said first fluid inlet associated with said first heat exchanger;

a second heat exchanger adapted to be disposed remotely from said reservoir and said stove or the like but elevated above said reservoir, said second heat exchanger having a second fluid flow inlet and a second fluid flow outlet;

said second fluid flow inlet coupled in fluid flow communication with said first fluid flow outlet;

said second fluid flow outlet coupled in fluid flow communication with at least one of said reservoir inlet(s);

fan means for forcing air through said second heat exchanger to extract and distribute heat therefrom;

immersion control switch means for initiating operation of said pump whereby to establish fluid recirculation between said reservoir and said first and second heat exchangers;

fan control means for energizing said fan means when the temperature of fluid within said second heat exchanger reaches a first preselected temperature; and, said immersion control means responsive to thermocouple means disposed within said reservoir for turning off said pump when the temperature of fluid within said reservoir exceeds a preselected safe maximum temperature, whereupon hot fluid disposed within said second heat exchanger will drop downwardly into said reservoir.

7. The stove as defined in claim 6 including solenoid valve means coupled in fluid flow communication between said pump outlet and said reservoir and electrically controlled by said immersion control switch for bypassing and draining said heat exchangers when either said thermocouple means senses said preselected maximum temperature or electrical power for said immersion control switch means is interrupted.

8. The heating device as defined in claim 7 including suction trap means disposed in fluid flow communication between said second heat exchanger outlet and said reservoir inlet.

9. The device of claim 8 including vent means for venting the fluid head within said reservoir to prevent reservoir head pressure from exceeding atmosheric pressure and for facilitating the escape of steam whereby to concurrently humidify said area in which said stove is disposed.

10. The device as in claim 9 including low level warning means associated with said reservoir operable when said heat exchange fluid within said reservoir assumes an impermissibly low operating level to generate a warning and to admit heat exchange fluid into said reservoir to maintain a proper operating level.

11. The insert as defined in claim 6 including solenoid valve means coupled in fluid flow communication between said pump outlet and said reservoir and electrically controlled by said immersion control switch for bypassing and draining said heat exchangers when either said thermocouple means senses said preselected maximum temperature or electrical power for said immersion control switch means is interrupted.

12. The insert as defined in claim 11 including suction trap means disposed in fluid flow communication between said second heat exchanger outlet and said reservoir inlet.

13. The insert of claim 12 including vent means for venting the fluid head within said reservoir to prevent reservoir head pressure from exceeding atmospheric pressure and for facilitating the escaape of steam whereby to concurrently humidify said area in which said fireplace is disposed.

14. The insert as in claim 13 including low level warning means associated with said reservoir operable when said heat exchange fluid within said reservoir assumes an impermissibly low operating level to generate a warning and to admit heat exchange fluid into said reservoir to maintain a proper operating level.

15. A fireplace insert for warming areas adjacent to a conventional fireplace in which said insert is adapted to be disposed, said insert comprising:

a rigid, upright, generally cubicle frame adapted to be disposed within said fireplace, an internal fuel combustion zone for burning coal, wood, or the like to generate heat;

a first heat exchanger adapted to be disposed within said fuel combustion zone, said first heat exchanger having a first fluid inlet and a first fluid outlet;

a reservoir adapted to be disposed remotely with respect to said combustion zone for containing a preselected volume of a working heat exchange fluid such as water or the like, said reservoir being vented to the atmosphere and having at least one reservoir inlet and a reservoir outlet;

a circulating pump for extracting said heat exchange fluid from said reservoir and for pumping it to said first heat exchanger, said pump having an inlet in fluid flow communication with said reservoir outlet and a pump outlet in fluid flow communication with said first fluid inlet associated with said first heat exchanger;

a second heat exchanger adapted to be disposed remotely from said reservoir and said stove or the like but elevated above said reservoir, said second heat exchanger having a second fluid flow inlet and a second fluid flow outlet;

said second fluid flow inlet coupled in fluid flow communication with said first fluid flow outlet;

said second fluid flow outlet coupled in fluid flow communication with at least one of said reservoir inlet(s);

fan means for forcing air through said second heat exchanger to extract and distribute heat therefrom;

immersion control switch means for initiating operation of said pump whereby to establish fluid recirculation between said reservoir and said first and second heat exchangers;

fan control means for energizing said fan means when the temperature of fluid within said second heat exchanger reaches a first preselected temperature; and, said immersion control means responsive to thermocouple means disposed within said reservoir for turning off said pump when the temperature of fluid within said reservoir exceeds a preselected safe maximum temperature, whereupon hot fluid disposed within said second heat exchanger will drop downwardly into said reservoir.

* * * * *